US006281916B1

(12) United States Patent
VanSteenkiste

(10) Patent No.: US 6,281,916 B1
(45) Date of Patent: Aug. 28, 2001

(54) INK SUPPLY APPARATUS AND METHOD

(75) Inventor: David G. VanSteenkiste, Scottsdale, AZ (US)

(73) Assignee: Fas-Co Coders Inc., Chandler, AZ (US)

( * ) Notice: Subject to any disclaimer, the term of this patent is extended or adjusted under 35 U.S.C. 154(b) by 0 days.

(21) Appl. No.: 09/533,164

(22) Filed: Mar. 21, 2000

(51) Int. Cl.[7] ..... B41J 2/175
(52) U.S. Cl. ..... 347/85
(58) Field of Search ..... 347/84, 85, 86, 347/87, 7

(56) References Cited

U.S. PATENT DOCUMENTS

| | | | | |
|---|---|---|---|---|
| 4,340,896 | | 7/1982 | Cruz-Uribe et al. | 347/85 |
| 4,380,771 | | 4/1983 | Takatori | 347/43 |
| 4,764,780 | | 8/1988 | Yamamori et al. | 347/27 |
| 5,189,438 | | 2/1993 | Hine et al. | 347/85 |
| 5,489,925 | | 2/1996 | Brooks et al. | 347/6 |
| 5,629,727 | | 5/1997 | Erickson | 347/85 |
| 5,898,448 | | 4/1999 | Ishikawa | 347/69 |
| 5,963,236 | | 10/1999 | Miyashita et al. | 347/85 |
| 5,992,986 | | 11/1999 | Gyotoku et al. | 347/85 |
| 6,059,405 | * | 5/2000 | Mochizuki et al. | 347/92 |
| 6,109,740 | * | 8/2000 | Namekawa et al. | 347/85 |

* cited by examiner

*Primary Examiner*—N. Le
*Assistant Examiner*—Anh T. N. Vo
(74) *Attorney, Agent, or Firm*—Schmeiser, Olsen & Watts

(57) ABSTRACT

An apparatus for supplying ink includes an ink source and at least one sub-reservoir that is fluidly connected to the ink source. In one embodiment, the sub-reservoir includes a housing container and a flexible container housed within the housing container. A sensor is connected to an actuator, wherein the sensor senses the height of the top surface of the flexible container. If the height of the top surface of the flexible container is below a height range, the sensor emits a signal that allows ink to flow from the ink source to the flexible container, and if the height of the top surface of the flexible container is above the height range, the sensor emits a signal that prevents ink from flowing from the ink source to the flexible container. The apparatus may include only one sub-reservoir, or it may include many sub-reservoirs. If plural sub-reservoirs are included, a print head may include plural portions that are each fluidly connected to a different sub-reservoir. If the print head portions are at different heights, such as when the print head is printing on a vertical or slanted surface, then the sub-reservoirs connected to those portions are also preferably at different heights so that the ink pressure at each of the portions is substantially the same.

23 Claims, 4 Drawing Sheets

INK SUPPLY APPARATUS AND METHOD

BACKGROUND OF THE INVENTION

1. Technical Field

This invention generally relates to a method and apparatus for supplying ink, and more specifically relates to a method and apparatus for supplying ink to a print head.

2. Background Art

The present invention is particularly well-suited for use with sophisticated ink jet printers, although it is not limited to use with such printers. With these ink jet printers, it is desirable to produce extremely high quality images on wide webs of paper or other printed surfaces and at very fast printing rates. The requirements of these apparatus in terms of accuracy of paper feed, methods of paper feed, and print head to paper distance are much higher than in conventional ink jet printers and pose problems not encountered in conventional printers.

U.S. Pat. No. 5,992,986 to Gyotoku et. al. provides a workable ink supply system for sophisticated ink jet printers. However, several problems arise from the ink supply system disclosed in Gyotoku et. al. First, a single supply must be used for all sub-reservoirs. Second, air is introduced into the ink within the sub-reservoirs, especially during priming of the system. Third, the supply system includes one print head for each sub-reservoir, which increases the complexity and cost of the system. Fourth, the supply system is prone to surges of ink within the system.

DISCLOSURE OF INVENTION

The present invention provides an ink supply system and a method of supplying ink that overcomes the problems associated with prior ink supply systems for sophisticated ink jet printers. However, the present invention may be used for supplying ink in applications other than for sophisticated ink jet printers.

According to the present invention, an apparatus for supplying ink includes an ink source and at least one sub-reservoir that is fluidly connected to the ink source. In one embodiment, the sub-reservoir includes a housing container and a flexible container housed within the housing container. A sensor is connected to an actuator, wherein the sensor senses the height of the top surface of the flexible container. If the height of the top surface of the flexible container is below a specified height range, the sensor emits a signal that allows ink to flow from the ink source to the flexible container, and if the height of the top surface of the flexible container is above the height range, the sensor emits a signal that prevents ink from flowing from the ink source to the flexible container.

The apparatus may include only one sub-reservoir, or it may include many sub-reservoirs. If plural sub-reservoirs are included, a print head may include plural portions that are each fluidly connected to a different sub-reservoir. If the print head portions are at different heights, such as when the print head is printing on a vertical or slanted surface, then the sub-reservoirs connected to those portions also can be at different heights so that the ink pressure at each of the portions is substantially the same. Also, if plural sub-reservoirs are included, ink is preferably supplied to each sub-reservoir independently of the other sub-reservoirs so that the ink source could include a separate supply reservoir for each sub-reservoir or for groups of sub-reservoirs. In one embodiment, the ink source includes a main reservoir and the fluid connection between each sub-reservoir inlet and the ink source is a gravity-fed conduit extending from the ink source to the sub-reservoir inlet.

A method of supplying ink to a print head according to the present invention in one embodiment includes supplying ink from a flexible container to a portion of a print head. The method also includes sensing the height of a top surface of the flexible container and supplying ink to the flexible container if the height of the top surface of the flexible container is below a height range. If the height of the top surface of the flexible container is above the height range, the method includes ceasing supplying ink to the flexible container. This method can be used for simultaneously supplying ink to plural flexible containers and from those containers to a print head.

A method of priming a print system according to the present invention includes pressurizing a space within a rigid container that houses a flexible container, and thereby biasing the flexible container, increasing an ink pressure within the flexible container, and forcing ink out of a print head that is fluidly connected to the flexible container. This method may also be used as part of the method of supplying ink. When it is so used, the method can include sensing an increased pressure and ceasing supplying ink to the flexible container while the pressure is increased.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

In the following discussion where multiple groups of numerical designations are used together, it will be appreciated that individual designations within different groups correspond as shown in the appended drawings.

Figure 1:
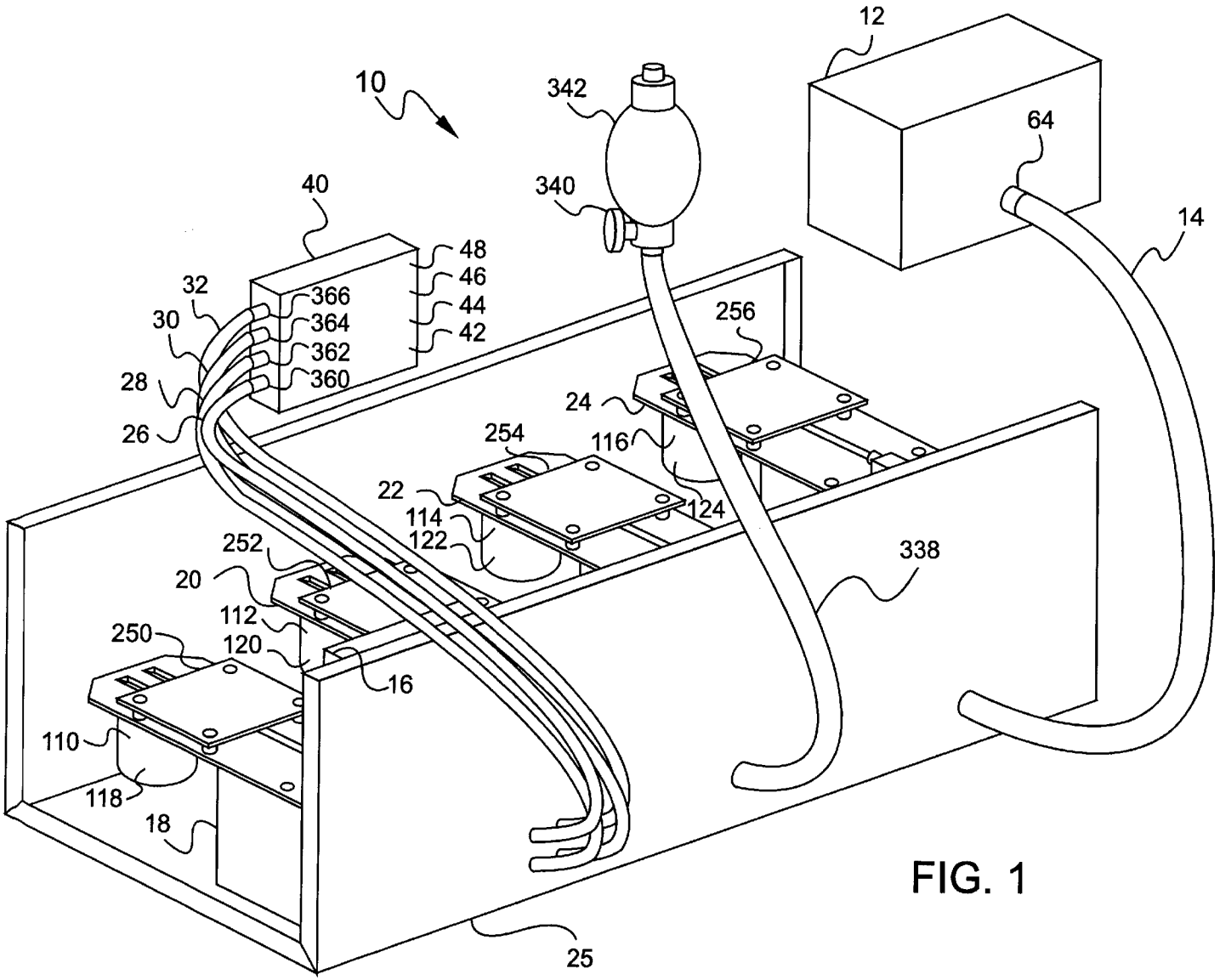
FIG. 1 is a perspective view of an ink supply system according to the present invention.
Figure 2:
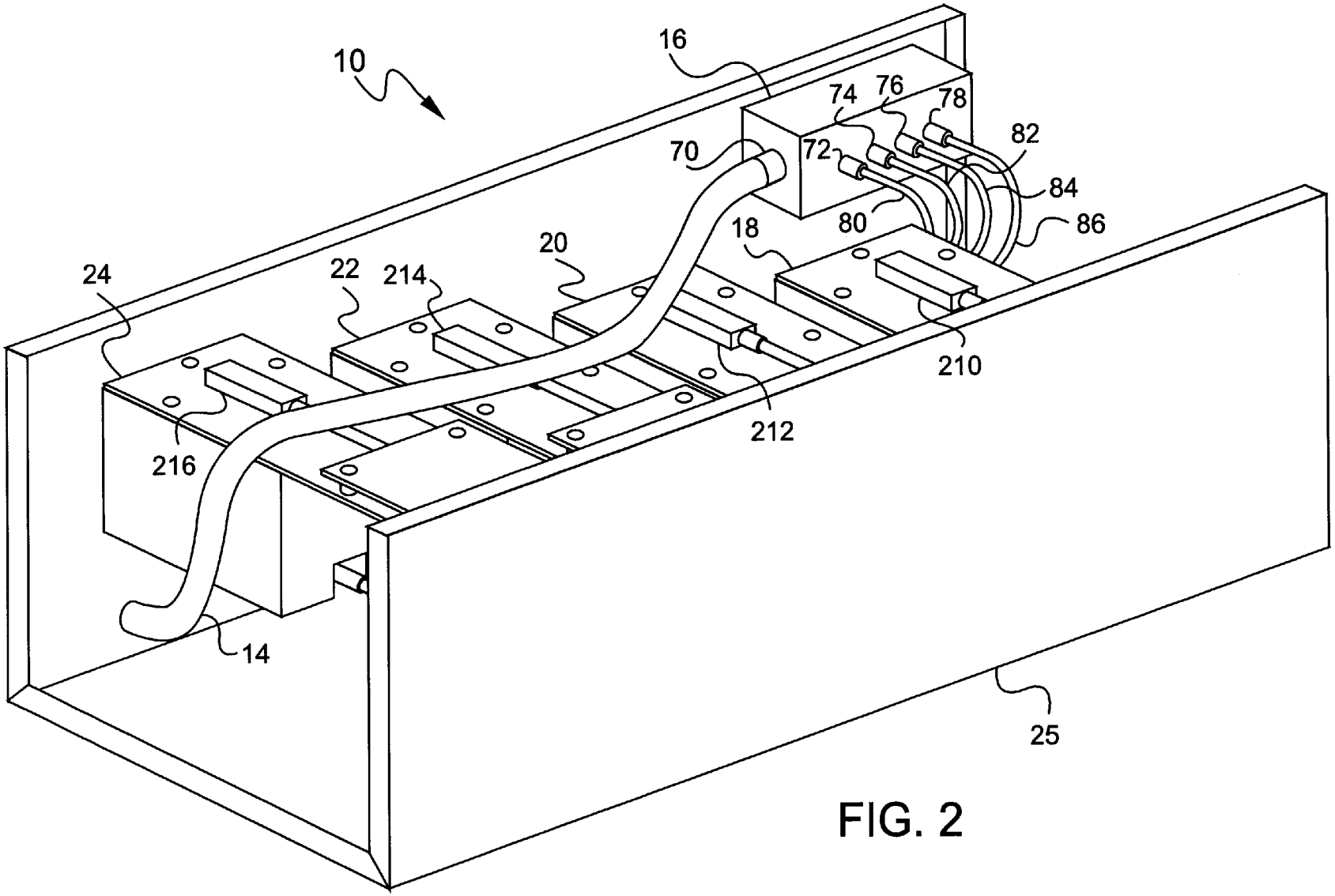
FIG. 2 is a perspective view of a portion of an ink supply system according to the present invention.

In ink jet printers, a print head typically has numerous small nozzles for spraying very fine ink sprays at specific times, and ink typically is provided to the print head from a reservoir. Referring now to FIGS. 1–2, a preferred embodiment of an ink supply system 10 generally includes a main reservoir 12 that preferably feeds ink through a conduit 14, through a manifold 16, and to several sub-reservoirs 18, 20, 22, 24 with the height of the fluid surface within each of the sub-reservoirs 18, 20, 22, 24 being staggered. Sub-reservoirs 18, 20, 22, 24 and manifold 16 are preferably secured to a frame 25 by fasteners, such as screws or bolts.

While FIGS. 1–2 show four sub-reservoirs 18, 20, 22, 24, those of skill in the art will recognize that the present invention will produce advantages with systems having any number of sub-reservoirs. Sub-reservoirs 18, 20, 22, 24 each feed a conduit 26, 28, 30, 32, respectively. Print head 40 includes portions 42, 44, 46, 48 that are fed by conduits 26, 28, 30, 32, respectively, and each of the portions 42, 44, 46, 48 provides ink to a surface to be printed. The heights of portions 42, 44, 46, 48 are staggered by substantially the same amount as the staggers of the fluid surfaces of the corresponding sub-reservoirs 18, 20, 22, 24. Thus, the main reservoir 12 is fluidly connected to each of the sub-reservoirs 18, 20, 22, 24, and each of the sub-reservoirs 18, 20, 22, 24 is fluidly connected to a corresponding portion 42, 44, 46, 48 of print head 40.

Figure 3:
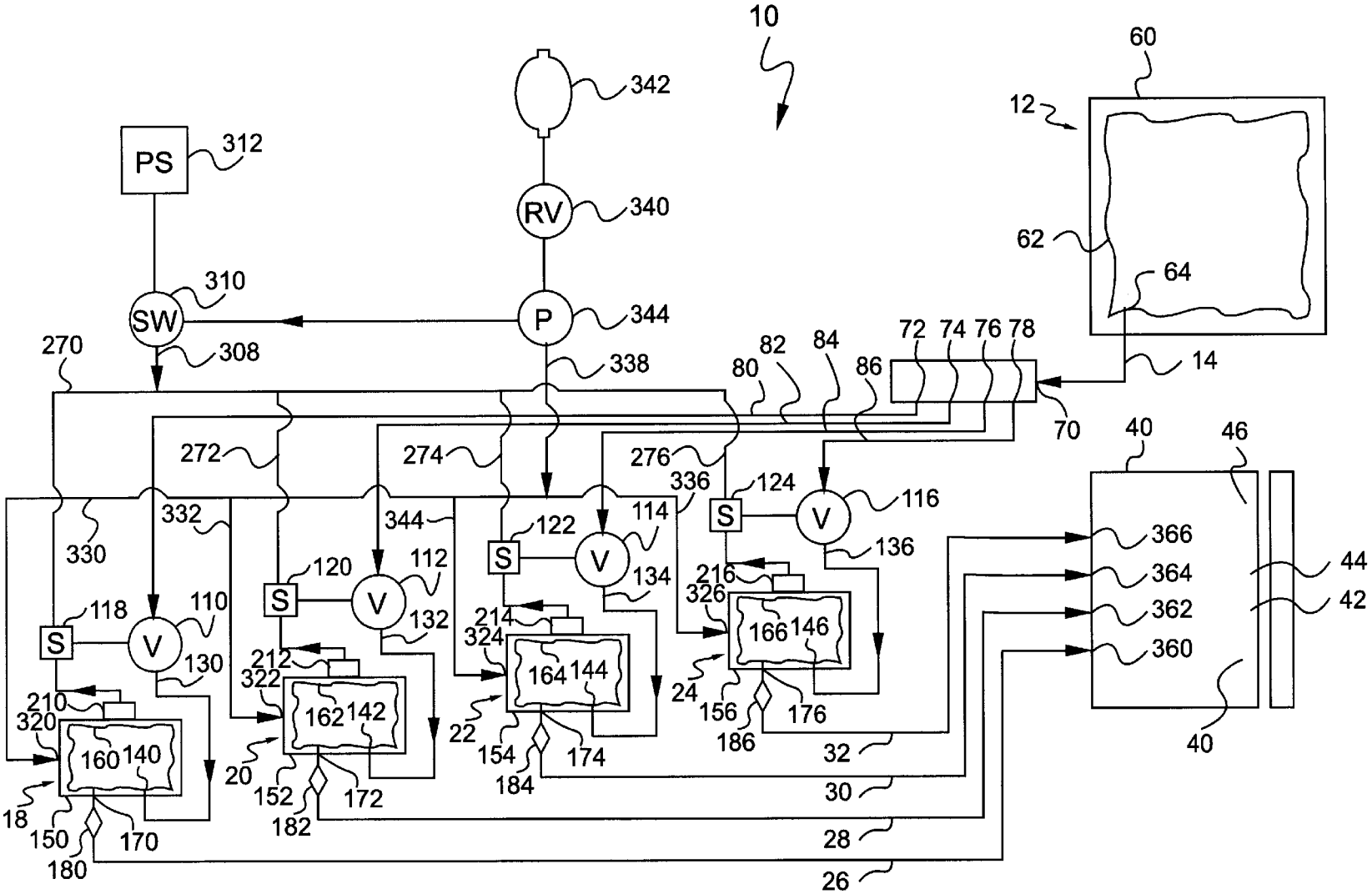
FIG. 3 is a schematic drawing of an ink supply system according to the present invention.

Referring now to FIG. 3, main reservoir 12 preferably acts as an ink source for ink supply system 10. Main reservoir 12 preferably includes a rigid support or container 60 and a main flexible container 62 that contains ink. Main flexible container or ink bag 62 is preferably sealed to prevent contaminants from entering the ink contained therein. Those of skill in the art will appreciate that other ink sources may be used, such as an open reservoir. As ink is drained from main flexible container 62, main flexible container 62 collapses until it is completely emptied. Main flexible container 62 includes an outlet 64 that is connected to conduit 14. Rigid support 60 can be any support that is sufficient to support flexible container 62, but it is preferably a cardboard box that defines a hole therein for supporting outlet 64. Main flexible container 60 is preferably collapsible as the container is drained and it preferably keeps contaminants, such as air away from the ink within the container. In a preferred embodiment, main flexible container 62 is an ink bag.

Conduit 14 is preferably a flexible tubing that can be easily attached to and detached from main flexible container 62. Conduit 14 is preferably made from a flexible material, such as high density polyethylene. Conduit 14 is preferably clear so that a user can view the ink within the conduit 14 to assure that ink is being properly supplied from main reservoir 12.

Conduit 14 preferably leads to a manifold 16, which includes a single inlet 70 and multiple outlets 72, 74, 76, 78, with each outlet 72, 74, 76, 78 corresponding to a sub-reservoir 18, 20, 22, 24. Manifold 16 may be any of several types of manifolds that will include a single inlet and multiple outlets. However, manifold 16 is preferably made of a resinous polymer material, such as the material sold under the trademark DELRIN by E. I. du Pont De Nemours and Company in Wilmington Del.

Figure 4:
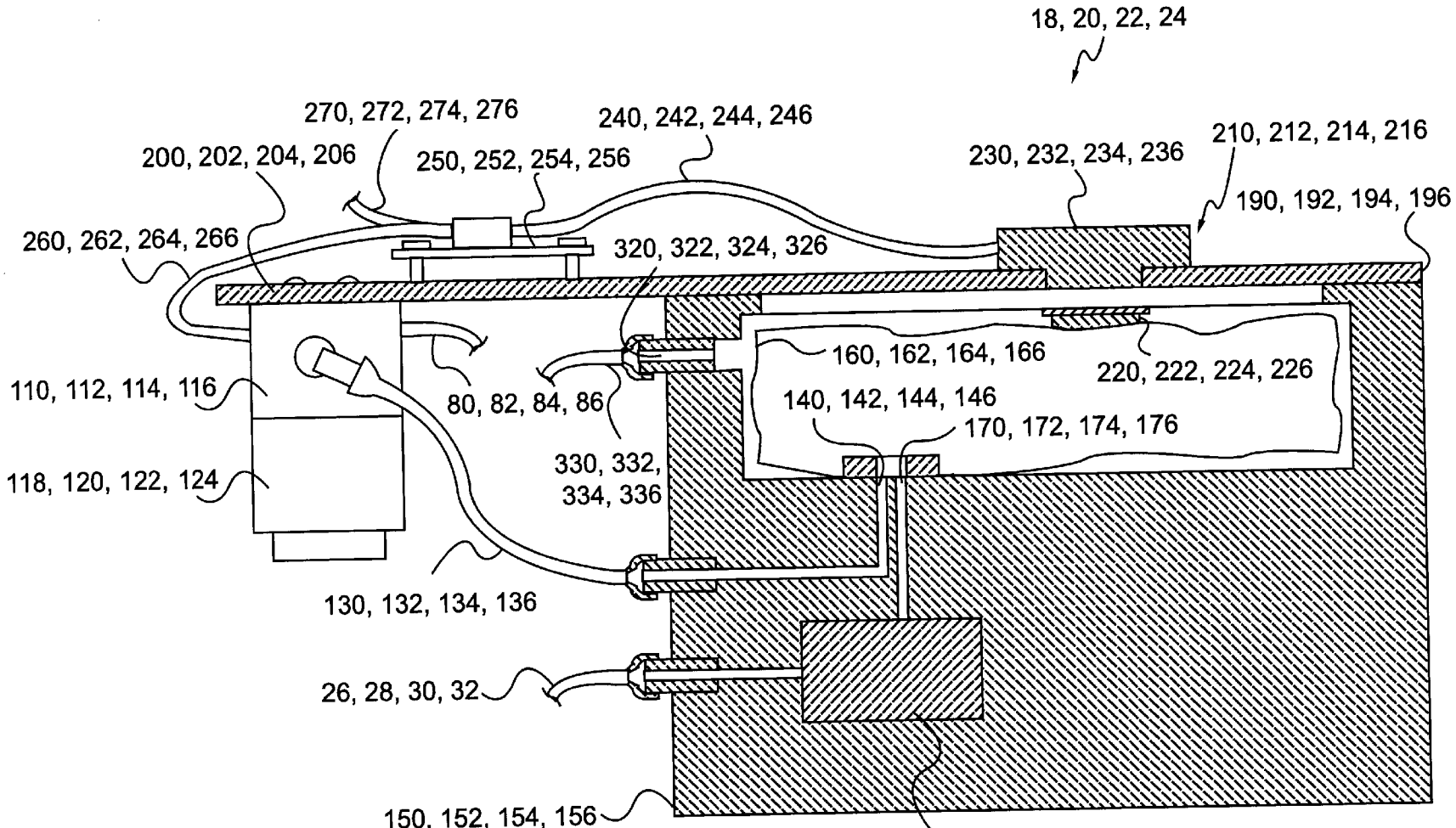
FIG. 4 is a cross-sectional view of a sub-reservoir system according to the present invention.

Each outlet 72, 74, 76, 78 is connected to a conduit 80, 82, 84, 86 that is preferably made from high density polyethylene. The tubing is preferably clear. Referring to FIGS. 3–4, each conduit 80, 82, 84, 86 preferably leads to a corresponding valve 110, 112, 114, 116 of a valve system that is actuated by an actuator such as solenoids 118, 120, 122, 124 of an actuator system. Preferably each valve-solenoid combination is the valve number A2013-S230 available from Precision Dynamics, Inc. in New Britain, Conn. However, each valve 110, 112, 114, 116 may be some other type of valve and may be actuated by some other type of actuator. For example, rather than having multiple valves 110, 112, 114, 116 and multiple actuators 118, 120, 122, 124, the valve system may include only one four-way valve, two two-way valves, or any of several other valve configurations. Likewise, the number and type of actuators within the actuator system can also be varied.

Referring still to FIGS. 3–4, conduits 130, 132, 134, 136 preferably lead from valves 110, 112, 114, 116, respectively, to sub-reservoir inlets 140, 142, 144, 146, respectively. Each sub-reservoir inlet 140, 142, 144, 146 preferably includes a fitting and extends through a housing container or rigid container 150, 152, 154, 156 that is preferably rigid and into the bottom of a flexible container 160, 162, 164, 166. Each flexible container 160, 162, 164, 166 is preferably housed within a corresponding rigid container 150, 152, 154, 156, and each flexible container 160, 162, 164, 166 and each rigid container 150, 152, 154, 156 are preferably sealed. Each sub-reservoir preferably also includes an outlet 170, 172, 174, 176 that extends through the bottom of a corresponding flexible container 160, 162, 164, 166, through a corresponding filter 180, 182, 184, 186 housed within each rigid container 150, 152, 154, 156 and out of sub-reservoir 18, 20, 22, 24 through a fitting. Each rigid container 150, 152, 154, 156 preferably includes a corresponding lid 190, 192, 194, 196 that is preferably fastened to the rigid container 150, 152, 154, 156 by fasteners such as screws or bolts and that encloses and seals the rigid container 150, 152, 154, 156. Each lid 190, 192, 194, 196 includes an extended portion 200, 202, 204, 206 that extends outwardly from the rigid container 150, 152, 154, 156 and supports solenoid 118, 120, 122, 124 and valve 110, 112, 114, 116.

The flexible container is preferably made of a flexible material that can be easily sealed. The rigid container is preferably made of a material that is rigid and easy to manufacture. In a preferred embodiment the rigid material is preferably made of the material sold under the trademark DELRIN.

A sensor 210, 212, 214, 216 senses the height of the fluid level of ink within each sub-reservoir 18, 20, 22, 24, respectively, by sensing the height of a top surface of each flexible container 160, 162, 164, 166. In a preferred embodiment, each sensor 210, 212, 214, 216 is an induction sensor that includes a conductive plate 220, 222, 224, 226 affixed to the top surface of each flexible container 160, 162, 164, 166, and a body 230, 232, 234, 236 affixed to the lid 190, 192, 194, 196 of each rigid container 150, 152, 154, 156. Each sensor 210, 212, 214, 216 preferably senses the distance from the body 230, 232, 234, 236 to the conductive plate 220, 222, 224, 226. Each sensor 210, 212, 214, 216 may be any type of sensor that will sense the height of the top surface of each flexible container 160, 162, 164, 166. In a preferred embodiment each sensor 210, 212, 214, 216 is an induction sensor such as the induction sensors sold under the trademark CUTLER-HAMMER available from Eaton Corporation in Cleveland, Ohio. A sensor line 240, 242, 244, 246 extends from each body 230, 232, 234, 236 to a control board 250, 252, 254, 256 that is secured to extended portion 200, 202, 204, 206 of lid 190, 192, 194, 196. An actuator line 260, 262, 264, 266 extends from each control board 250, 252, 254, 256 to a corresponding solenoid 118, 120, 122, 124. Referring still to FIGS. 3–4, a power supply line 270, 272, 274, 276 extends from each control board 250, 252, 254, 256 to a main power line 308. Main power line 308 extends through a power switch 310 and to a power source 312.

Each control board 250, 252, 254, 256 provides a signal through actuator line 260, 262, 264, 266 to solenoid 118, 120, 122, 124 if the height of the top surface of flexible container 150, 152, 154, 156 is above or below a given range. Such control boards are well known to those skilled in the art.

Referring still to FIGS. 3–4, each sub-reservoir defines a pressure inlet 320, 322, 324, 326 that extends through a fitting and into each rigid container 150, 152, 154, 156. Each pressure inlet 320, 322, 324, 326 is connected to a sub-pressure line 330, 332, 334, 336 that is connected to a main pressure line 338, which extends through a relief valve 340 and to a pressure source 342. Referring to FIG. 1, pressure source 342 is preferably a hand-squeezable bulb of a type that is well known for supplying pressure in other uses, such as taking blood pressure. Referring to FIGS. 3–4, pressure transducer 344 is preferably connected to power switch 310 to form a pressure switch. The model MPL-601-G-14.8 PSI pressure switch available from Micro Pneumatic Logic in Fort Lauderdale, Fla. is particularly well-suited to the present invention, though any of several pressure switches will work with the present invention.

A conduit 26, 28, 30, 32 is connected to each outlet 170, 172, 174, 176, respectively, and extends to a corresponding inlet 360, 362, 364, 366 in print head 40. Referring now to FIGS. 1 and 3, each inlet 360, 362, 364, 366 feeds a portion 42, 44, 46, 48 of print head 40. Each portion 42, 44, 46, 48 is preferably above the corresponding sub-reservoir 18, 20, 22, 24, respectively. The staggers in height of the sub-reservoirs 18, 20, 22, 24 should be substantially equal to the staggers in height of the print head portions 42, 44, 46, 48 so that the height difference between each sub-reservoir 18, 20, 22, 24 and each corresponding print head portion 42, 44, 46, 48 is substantially the same. In a preferred embodiment, the height difference between adjacent sub-reservoirs 18, 20, 22, 24 is about 0.7 inch when print head 40 is printing on a vertical surface. If the height differences are not substantially the same, then the pressures at different portions 42, 44, 46, 48 of print head 40 will deviate substantially from each other. Such deviated pressures will disrupt operation of print head 40.

Thus, the staggers between the sub-reservoirs 18, 20, 22, 24 should be increased or decreased depending on the orientation of print head 40. For example, the staggers should be greater if the print head portions 42, 44, 46, 48 are vertically aligned than if the print head portions 42, 44, 46, 48 are aligned along a line at a 45 degree angle. Accordingly, if the print head portions 42, 44, 46, 48 are horizontally aligned, then there is substantially no stagger between the sub-reservoirs 18, 20, 22, 24. Thus, the present invention can be adapted for use with print heads at any of several different orientations.

Print head 40 is preferably a type of print head that has multiple inlets, which each feed a separate portion. For example, the 500 print head with multiple inlets available from XaarJet in Cambridge, England works particularly well. However, multiple print heads, such as multiple 128 print heads, could be used rather than using a single print head with multiple inlets feeding multiple portions. Also, in some applications it might be preferable to use aspects of the present invention with a single print head having a single inlet. Those skilled in the art will recognize and be able to implement the adaptations necessary for using such print heads with the present invention.

Referring now to FIGS. 3–4, in using the ink supply system 10, sub-reservoirs 18, 20, 22, 24 must first be filled. This is done by fluidly connecting main reservoir or ink source 12 to sub-reservoirs 18, 20, 22, 24 through valves 110, 112, 114, 116 such that main reservoir 12 is above sub-reservoirs 18, 20, 22, 24 and will feed sub-reservoirs 18, 20, 22, 24 by force of gravity on the ink. Initially, sensors 210, 212, 214, 216 will sense that conductive plates 220, 222, 224, 226 and thus the top surfaces of flexible containers 160, 162, 164, 166 are below a specified range. Sensors 210, 212, 214, 216 will then send signals to control boards 250, 252, 254, 256 , which will send signals to solenoids 118, 120, 122, 124, which will open valves 110, 112, 114, 116, thereby supplying ink to flexible containers 160, 162, 164, 166. Once each flexible container 160, 162, 164, 166 is filled above the specified range, sensors 210, 212, 214, 216 will sense that conductive plates 220, 222, 224, 226 and thus the top surfaces of flexible containers 160, 162, 164, 166 are above the specified range. Sensors 210, 212, 214, 216 will then send signals to control boards 250, 252, 254, 256, which will send signals to solenoids 118, 120, 122, 124, which will close valves 110, 112, 114, 116 thereby ceasing the supplying of ink to flexible containers 160, 162, 164, 166. During filling, each sub-reservoir 18, 20, 22, 24 and each corresponding sensor 210, 212, 214, 216, solenoid 118, 120, 122, 124 and valve 110, 112, 114, 116 acts independently of the other sub-reservoirs, sensors, solenoids, and valves. The sub-reservoirs 18, 20, 22, 24 are preferably filled to a depth of from about 0.2 inch to about 1.1 inches.

Once each flexible container 160, 162, 164, 166 is filled, ink supply system 10 is primed. To prime the system, air pressure is supplied to rigid containers 150, 152, 154, 156. Preferably, pressure is supplied by squeezing the bulb on pressure source 342 (see FIG. 1). The squeezing is repeated a specified number of times or for a specified period of time. This pressurizes the space within each rigid container 150, 152, 154, 156 and thereby biases each flexible container 160, 162, 164, 166 inwardly and increases the pressure of ink within each flexible container 160, 162, 164, 166. The increased pressure within each flexible container 160, 162, 164, 166 forces ink through conduits 26, 28, 30, 32 and through corresponding portions 42, 44, 46, 48 of print head 40. This should be continued for a sufficient time so that air and other contaminants within ink supply system 10 are forced out of print head 40.

If valves 110, 112, 114, 116 are open while the ink pressure is increased within flexible containers 160, 162, 164, 166, ink may be forced back into main reservoir 12. However, when pressure transducer 344 senses increased pressure, it sends a signal to power switch 310, which opens to prevent power from reaching solenoids 118, 120, 122, 124. Thus, solenoids 118, 120, 122, 124 are unable to open valves 110, 112, 114, 116 while pressure is increased and ink cannot flow back from sub-reservoirs 18, 20, 22, 24 and into main reservoir 12 while ink supply system 10 is being primed.

The use of flexible containers 160, 162, 164, 166 within rigid containers 150, 152, 154, 156 allows volatile solvent-based inks to be effectively used with ink supply system 10. Such solvent-based inks tend to absorb air, especially pressurized air. Such absorbed air can then be passed through the system to the print head, where it will cause gaps in the printed area. However, such solvent-based inks are advantageous, especially during fast-paced printing processes, because they dry quickly when applied to a printed surface. The use of flexible containers 160, 162, 164, 166 within rigid containers 150, 152, 154, 156 allows air pressure to force ink through the system during priming without bringing the pressurized air into contact with the ink in the sub-reservoirs 18, 20, 22, 24. Moreover, if air were left in contact with ink in the sub-reservoirs 18, 20, 22, 24 during printing, solvents within the ink could evaporate at such a rate as to change the viscosity of the ink.

Once the system is primed, relief valve 340 is opened to relieve pressure within sub-reservoirs 18, 20, 22, 24 (see FIG. 1). The system is then ready for printing.

During printing, ink is supplied from each sub-reservoir 18, 20, 22, 24 to a corresponding portion 42, 44, 46, 48 of print head 40 by capillary action through conduits 26, 28, 30, 32. Accordingly, the height difference between each sub-reservoir 18, 20, 22, 24 and each corresponding print head portion 42, 44, 46, 48 should be such as to provide proper capillary action pressure to the print head used. In a preferred embodiment, the distance from the bottom of each sub-reservoir 18, 20, 22, 24 to the lowest nozzle of the corresponding portion 42, 44, 46, 48 of print head 40 that it feeds is from about 1 inch to about 2 inches, with 1.5 inches providing particularly good results. As each sub-reservoir 18, 20, 22, 24 is drained so that the top surface of flexible container 160, 162, 164, 166 falls below the specified range, the corresponding valve 110, 112, 114, 116 is opened and the sub-reservoir 18, 20, 22, 24 is filled from main reservoir 12 until the top surface of flexible container 160, 162, 164, 166 rises above the specified range, at which time the valve 110, 112, 114, 116 is closed, as described above. Preferably, the specified range is about 3 mm so that the height of the top surface varies by about 3 mm during printing. However, the range could be smaller or larger than 3 mm. This filling process continues for each sub-reservoir 18, 20, 22, 24 during printing.

Because each sub-reservoir 18, 20, 22, 24 is filled independently, each sub-reservoir 18, 20, 22, 24 can be filled appropriately, even though the sub-reservoirs 18, 20, 22, 24 may be drained at different rates during printing. Moreover, because each sub-reservoir 18, 20, 22, 24 is filled independently, multiple ink sources can be used, such as ink sources with different colors. This would allow different colors to be used for different portions of print head 40, allowing as much as one separate color for each portion 42, 44, 46, 48 of print head 40. Moreover, the present invention will provide advantageous results if multiple print heads are used or if more or fewer sub-reservoirs are used. For example, the present invention would even provide advantageous results if it were used with a single sub-reservoir.

While the invention has been particularly shown and described with reference to preferred embodiments thereof, it will be understood by those skilled in the art that various changes in form and details may be made therein without departing from the spirit and scope of the invention.

What is claimed is:

1. An apparatus for supplying ink, the apparatus comprising:

(1) an ink source;

(2) a first sub-reservoir comprising:

(a) a first housing container;

(b) a first flexible container housed within the first housing container, the first flexible container comprising an outlet, an inlet that is fluidly connected to the ink source, and a top surface; and (3) a first sensor connected to an actuator, wherein the first sensor senses a height of the top surface of the first flexible container, such that when the height of the top surface of the first flexible container is below a first height range, the first sensor emits a signal that instructs a device to allow ink to flow from the ink source to the inlet of the first flexible container, and when the height of the top surface of the first flexible container is above the first height range, the first sensor emits a signal that instructs a device to prevent the ink from flowing from the ink source to the inlet of the first flexible container, the apparatus comprising a closed system wherein air is sealed outside the system and not allowed to flow into the system's components.

2. The apparatus of claim 1, wherein the first housing container is rigid.

3. The apparatus of claim 1, further comprising:

(4) a valve system fluidly connected to the ink source and the actuator, wherein the first sensor is connected to the actuator and the actuator actuates a valve in the valve system upon receiving the signal from the first sensor.

4. The apparatus of claim 1, wherein the ink source comprises a main reservoir and wherein a fluid connection between the inlet of the first flexible container and the ink source comprises a gravity-fed conduit extending from the ink source to the first flexible container inlet.

5. The apparatus of claim 1, wherein the inlet of the first flexible container is located at the bottom of the first flexible container.

6. The apparatus of claim 1, further comprising:

(4) a second sub-reservoir comprising:

(a) a second housing container;

(b) a second flexible container housed within the second housing container, the second flexible container comprising an outlet, an inlet that is fluidly connected to the ink source, and a top surface; and (5) a second sensor connected to the actuator, wherein the second sensor senses a height of the top surface of the second flexible container, such that if the height of the top surface of the second flexible container is below a second height range, the second sensor emits a signal that instructs a device to allow ink to flow from the ink source to the inlet of the second flexible container, and if the height of the top surface of the second flexible container is above the second height range, the second sensor emits a signal that instructs a device to prevent ink from flowing from the ink source to the inlet of the second flexible container; and (6) a print head comprising:

(a) a first print head portion fluidly connected to the outlet of the first flexible container; and (b) a second print head portion fluidly connected to the outlet of the second flexible container, the second print head portion being above the first print head portion, whereby a first pressure at the first print head portion is substantially equal to a second pressure at the second print head portion.

7. The apparatus of claim 1, wherein the first flexible container is sealed, such that the air pressure surrounding the flexible container may be increased, thus priming the apparatus for supplying ink, without introducing gases or other contaminants into the system, and having means to prevent the ink from flowing back into the sub-reservoirs and the ink source.

8. The apparatus of claim 1, wherein the first housing container is sealed.

9. An apparatus for supplying ink, the apparatus comprising:

(1) an ink source;

(2) a first ink sub-reservoir comprising:

(a) a first top fluid surface at a first sub-reservoir fluid height;

(b) a first sub-reservoir inlet fluidly connected to the ink source; and (c) a first sub-reservoir outlet;

(3) a second ink sub-reservoir comprising:

(a) a second top fluid surface at a second sub-reservoir fluid height that is above the first sub-reservoir fluid height;

(b) a second sub-reservoir inlet fluidly connected to the ink source; and (c) a second sub-reservoir outlet; and (4) a print head comprising:

(a) a first print head portion fluidly connected to the first sub-reservoir outlet; and (b) a second print head portion fluidly connected to the second sub-reservoir outlet, the second print head portion being above the first print head portion, whereby a first pressure at the first print head portion is substantially equal to a second pressure at the second print head portion, the apparatus comprising a closed system wherein air is sealed outside the system and not allowed to flow into the system's components.

10. The apparatus of claim 9, wherein the first ink sub-reservoir further comprises:

(d) a first flexible container fluidly connected to the first sub-reservoir inlet and the first sub-reservoir outlet; and (e) a first rigid container housing the first flexible container; and wherein the second ink sub-reservoir further comprises:

(d) a second flexible container fluidly connected to the first sub-reservoir inlet and the first sub-reservoir outlet; and (e) a second rigid container housing the second flexible container.

11. The apparatus of claim 9, further comprising:

(5) a valve system fluidly connected to the ink source;

(6) an actuator system connected to the valve system;

(7) a first sensor connected to the actuator system, wherein the first sensor senses the first sub-reservoir fluid height, such that if the first sub-reservoir fluid height is below a first height range, the first sensor emits a signal to the actuator system, whereby the actuator system actuates the valve system, the valve system allowing ink to flow from the ink source to the first sub-reservoir inlet, and if the first sub-reservoir fluid height is above the first height range, the first sensor emits a signal to the actuator system, whereby the actuator system actuates the valve system, the valve system preventing ink from flowing from the ink source to the first sub-reservoir inlet; and (8) a second sensor connected to the actuator system, wherein the second sensor senses the second sub-reservoir fluid height, such that if the second sub-reservoir fluid height is below a second height range, the second sensor emits a signal to the actuator system, whereby the actuator system actuates the valve system, the valve system allowing ink to flow from the ink source to the second sub-reservoir inlet, and if the second sub-reservoir fluid height is above the second height range, the second sensor emits a signal to the actuator system, whereby the actuator system actuates the valve system, the valve system preventing ink from flowing from the ink source to the second sub-reservoir inlet.

12. The apparatus of claim 11, wherein the actuator system comprises a first actuator connected to the first sensor and a second actuator connected to the second sensor, and wherein the valve system comprises a first valve connected to the first actuator and fluidly connected to the first sub-reservoir, and a second valve connected to the second actuator and fluidly connected to the second sub-reservoir.

13. The apparatus of claim 9, wherein the ink source comprises a main reservoir, wherein a fluid connection between the first sub-reservoir inlet and the ink source comprises a gravity-fed conduit extending from the ink source to the first sub-reservoir inlet, and wherein a fluid connection between the second sub-reservoir inlet and the ink source comprises a gravity-fed conduit extending from the ink source to the second sub-reservoir inlet.

14. The apparatus of claim 9, wherein the first sub-reservoir inlet is located at the bottom of the first sub-reservoir, and wherein the second sub-reservoir inlet is located at the bottom of the second sub-reservoir.

15. The apparatus of claim 9, further comprising:

(5) a third ink sub-reservoir comprising:

(a) a third top fluid surface at a third sub-reservoir fluid height that is above the second sub-reservoir fluid height;

(b) a third sub-reservoir inlet fluidly connected to the ink source; and (b) a third sub-reservoir outlet; and (6) a fourth ink sub-reservoir comprising:

(a) a fourth top fluid surface at a fourth sub-reservoir fluid height that is above the third sub-reservoir fluid height;

(b) a fourth sub-reservoir inlet fluidly connected to the ink source; and (b) a fourth sub-reservoir outlet; and wherein the print head further comprises:

(c) a third print head portion fluidly connected to the third sub-reservoir outlet; and (d) a fourth print head portion fluidly connected to the fourth sub-reservoir outlet, the fourth print head portion being above the third print head portion and the third print head portion being above the second print head portion, whereby a third pressure at the third print head portion and a fourth pressure at the fourth print head portion are substantially equal to the first pressure at the first print head portion and the second pressure at the second print head portion.

16. An apparatus for supplying ink, the apparatus comprising:

(1) a main reservoir;

(2) a valve system fluidly connected to the main reservoir;

(3) an actuator system connected to the valve system, the actuator system comprising a first actuator and a second actuator;

(4) a first sub-reservoir comprising:

(a) a sealed first rigid container;

(b) a sealed first flexible container housed within the first rigid container, the first flexible container comprising an outlet at the bottom of the first flexible container, an inlet at the bottom of the first flexible container that is fluidly connected to the valve system, and a top surface, such that the main reservoir feeds ink into the inlet of the first flexible container when the valve system fluidly connects the inlet of the first flexible container to the main reservoir;

(5) a first sensor connected to the first actuator, wherein the first sensor senses a height of the top surface of the first flexible container relative to the first rigid container, such that if the height of the top surface of the first flexible container is below a first height range relative to the first rigid container, the first sensor emits a signal to the first actuator, whereby the first actuator actuates the valve system, the valve system allowing ink to flow from the ink source to the inlet of the first flexible container, and if the height of the top surface of the first flexible container is above the first height range relative to the first rigid container, the first sensor emits a signal to the first actuator, whereby the first actuator actuates the valve system, the valve system preventing ink from flowing from the ink source to the inlet of the first flexible container;

(6) a second sub-reservoir comprising:
(a) a sealed second rigid container;
(b) a sealed second flexible container housed within the second rigid container, the second flexible container comprising an outlet at the bottom of the second flexible container, an inlet at the bottom of the second flexible container that is fluidly connected to the valve system, and a top surface, such that the main reservoir feeds ink into the inlet of the second flexible container when the valve system fluidly connects the inlet of the second flexible container to the main reservoir, wherein a fluid connection of the second flexible container to the main reservoir comprises a gravity-fed conduit and does not include the first sub-reservoir and wherein a fluid connection of the first flexible container to the main reservoir comprises a gravity-fed conduit and does not include the second flexible container;

(7) a second sensor connected to the second actuator, wherein the second sensor senses the height of the top surface of the second flexible container relative to the second rigid container, such that if the height of the top surface of the second flexible container is below a second height range relative to the second rigid container, the second sensor emits a signal to the second actuator, whereby the second actuator opens the valve, the valve allowing ink to flow from the ink source to the inlet of the second flexible container, and if the height of the top surface of the second flexible container is above the second height range relative to the second rigid container, the second sensor emits a signal to the second actuator, whereby the second actuator closes the valve, the valve preventing ink from flowing from the ink source to the inlet of the second flexible container; and (8) a print head comprising:
(a) a first print head portion fluidly connected to the outlet of the first flexible container; and
(b) a second print head portion fluidly connected to the outlet of the second flexible container, the second print head portion being above the first print head portion, whereby a first pressure at the first print head portion is substantially equal to a second pressure at the second print head portion, the apparatus comprising a closed system wherein air is sealed outside the system and not allowed to flow into the system's components.

17. A method of priming an ink source apparatus, the apparatus comprising a closed system wherein air is sealed outside the system and not allowed to flow into the system's components, the method comprising the steps of:

(1) pressurizing a space within a first rigid container, and thereby:
(a) biasing a first flexible container that is housed with the first rigid container, the first flexible container containing ink;
(b) increasing the ink pressure within the first flexible container; and
(c) forcing ink out of a first portion of a print head, the first portion of the print head being fluidly connected to the first flexible container.

18. The method of claim 17, further comprising the steps of:

(1) pressurizing a space within a second rigid container, and thereby:
(a) biasing a second flexible container that is housed with the second rigid container, the second flexible container containing ink;
(b) increasing the ink pressure within the second flexible container; and
(c) forcing ink out of a second portion of the print head, the second portion of the print head being fluidly connected to the second flexible container.

19. A method of supplying ink to a print head, the method comprising the steps of, in an apparatus comprising a closed system wherein air is sealed outside the system and not allowed to flow into the system's components:

(1) supplying ink from a first flexible container to a first portion of a print head;
(2) sensing a height of a top surface of the first flexible container;
(3) supplying ink to the first flexible container if the height of the top surface of the first flexible container is below a first height range; and
(4) ceasing supplying ink to the first flexible container if the height of the top surface of the first flexible container is above the first height range.

20. The method of claim 19, further comprising the steps of:

(5) supplying ink from a second flexible container to a second portion of the print head that is above the first portion of the print head;
(6) sensing a height of a top surface of the second flexible container, the height of the top surface of the second flexible container being above the height of the top surface of the first flexible container;
(7) supplying ink to the second flexible container if the height of the top surface of the second flexible container is below a second height range; and
(8) ceasing supplying ink to the second flexible container if the height of the top surface of the second flexible container is above the second height range.

21. The method of claim 19, wherein the step of supplying ink to the first flexible container comprises using gravity to feed ink through a conduit that extends from an ink source to the first flexible container.

22. The method of claim 19, wherein the step of supplying ink to the first flexible container comprises actuating a valve system and wherein the step of ceasing supplying ink to the second flexible container comprises actuating the valve system.

23. The method of claim 19, further comprising the steps of:

(5) pressurizing a space within a rigid container that houses the first flexible container, and thereby:
(a) biasing the first flexible container;
(b) increasing an ink pressure within the first flexible container; and
(c) forcing ink out of a print head that is fluidly connected to the first flexible container; and
(6) sensing an increased pressure and ceasing supplying ink to the first flexible container.

* * * * *